US005529233A

United States Patent [19]

Davignon et al.

[11] Patent Number: 5,529,233

[45] Date of Patent: Jun. 25, 1996

[54] ELECTRIC POWERED APPARATUS FOR DISPENSING INDIVIDUAL PLASTIC FASTENERS FROM FASTENER STOCK

[75] Inventors: Paul A. Davignon, Uxbridge, Mass.; Richard M. Bastien, Cumberland, R.I.

[73] Assignee: Avery Dennison Corporation, Pasadena, Calif.

[21] Appl. No.: 332,520

[22] Filed: Oct. 31, 1994

Related U.S. Application Data

[63] Continuation-in-part of Ser. No. 130,644, Oct. 1, 1993, Pat. No. 5,388,748, which is a continuation-in-part of Ser. No. 61,210, May 13, 1993, abandoned.

[51] Int. Cl.[6] ..... B65C 7/00

[52] U.S. Cl. ..... 227/67

[58] Field of Search ..... 227/67, 76, 2; 173/117, 217

[56] References Cited

U.S. PATENT DOCUMENTS

| | | | |
|---|---|---|---|
| 3,103,666 | 9/1963 | Bone . | |
| 3,470,834 | 10/1969 | Bone . | |
| 3,735,908 | 5/1973 | Kinney et al. | 227/67 |
| 4,121,487 | 10/1978 | Bone . | |
| 4,125,215 | 11/1978 | Jenkins | 227/67 |
| 4,456,123 | 6/1984 | Russell . | |
| 4,456,161 | 6/1984 | Russell . | |
| 4,838,469 | 6/1989 | Strausburg | 227/67 |
| 4,955,475 | 9/1990 | McCarthy et al. . | |
| 4,971,238 | 11/1990 | Farutsu | 227/2 X |
| 4,998,661 | 3/1991 | Deschenes et al. . | |

*Primary Examiner*—Scott A. Smith
*Attorney, Agent, or Firm*—Kriegsman & Kriegsman

[57] ABSTRACT

An apparatus for dispensing plastic fasteners from fastener stock includes a gun shaped casing. A hollow needle having an inlet opening is mounted on the casing. A guide groove is formed on the casing for receiving the fastener stock, the guide groove being in communication with said inlet opening in said hollow needle. A feeder element for intermittently advancing fastener stock loaded into the guide groove is mounted on the casing. An ejector rod is provided for pushing plastic fasteners from the fastener stock through and out of the hollow needle one at a time. The ejector rod and feeder element are driven by a DC motor powered by a battery pack removably mounted in the casing and which contains rechargeable batteries. The battery pack includes a receptacle which is arranged to enable the batteries to be recharged with the battery pack in or out of the tool. A converter assembly is provided for converting rotary motion of the drive shaft of the motor into linear motion of the ejector rod, the converter assembly including a worm on the drive shaft, a worm gear driven by the worm, a spur gear loosely coupled to the worm gear, a slider for holding the ejector rod and a rack driven by the spur gear and mounted on the slider.

6 Claims, 18 Drawing Sheets

ELECTRIC POWERED APPARATUS FOR DISPENSING INDIVIDUAL PLASTIC FASTENERS FROM FASTENER STOCK

CROSS REFERENCE TO RELATED APPLICATION

This application is a continuation-in-part of U.S. patent application Ser. No. 08/130,644 filed in the names of Paul A. Davignon and Richard M. Bastien on Oct. 1, 1993 and assigned to Avery Dennison Corporation now U.S. Pat. No. 5,388,748, the assignee of this application and which in turn is a continuation-in-part of U.S. patent application Ser. No. 08/061,210 filed in the names of Paul A. Davignon and Richard M. Bastien on May 13, 1993, now abandoned.

BACKGROUND OF THE INVENTION

The present invention relates to a new and improved apparatus for dispensing individual plastic fasteners from fastener stock.

Plastic fasteners of the type having a cross bar at one end, a paddle at the other end and a thin filament or cross-link connecting the two ends are well known in the art and widely used in commerce to attach labels, price tags or other items to articles in a manner which minimizes the risk of inadvertent detachment therefrom. Typically, such plastic fasteners are manufactured in the form of fastener stock, the fastener stock being produced by molding or stamping from flexible plastic materials, such as nylon, polyethylene, and polypropylene. In one known type of fastener stock, the cross bar end of each fastener is connected to a runner bar to form a clip of fasteners. In another known type of fastener stock, often referred to as ladder stock, a pair of elongated side members are interconnected by a plurality of cross links or filaments. One of the side members is shaped to define a plurality of cross bars which are joined together by short severable connectors, the connectors being defined by indentations or notches formed along the side member. The other side member is shaped to define a plurality of paddles.

Additional information pertaining to fastener stock may be obtained from the following commonly assigned U.S. patents, all of which are incorporated herein by reference: U.S. Pat. No. 4,955,475 issued Sep. 11, 1990; U.S. Pat. No. 4,456,161, issued Jun. 26, 1984; U.S. Pat. No. 4,121,487, issued Oct. 24, 1978; U.S. Pat. 3,470,834, issued Oct. 7, 1969 and U.S. Pat. No. 3,103,666, issued Sep. 17, 1963.

The dispensing of individual fasteners from fastener stock is often accomplished with an apparatus commonly referred to as a "tagger gun". Typically, a tagger gun is a hand held trigger operated gun shaped device which is constructed to accept fastener stock and which includes a mechanism for feeding the cross bar end of a fastener into a hollow needle at the front end of the gun and a mechanism for pushing the cross bar end of the fastener that has been fed into the hollow needle out through the tip of the hollow needle.

In commonly assigned U.S. Pat. No. 5,024,365, which issued Jun. 18, 1991 and which is herein incorporated by reference, a tagger gun for dispensing a plastic fastener through a slotted hollow needle from continuously connected fastener stock is described. The apparatus includes an actuator slide with a central channel, the actuator slide being secured to an ejector rod and fastener stock feed mechanism to actuate these functions. The apparatus further includes a shuttle assembly which reciprocates transversely to the needle axis to cause the cutting of a fastener from the fastener stock, and transport of the severed fastener to the needle axis. The cam bar is linked to the shuttle mechanism and pivotally mounted so that the pivoting of the cam bar causes the transverse shuttle motion. The cam bar passes through the actuator slide channel, whereby sliding of the actuator slide causes pivoting of the cam bar according to the profile of the cam. The apparatus, further includes an anti-back mechanism in the form of a catch lever which engages the trigger when it has been partially depressed and prevents its release, until the trigger has been fully depressed.

In commonly assigned U.S. Pat. No. 4,456,161, which issued Jun. 26, 1984, another tagger gun for dispensing fasteners is described. The apparatus comprises a casing, a fastener dispensing hollow slotted needle mounted on the casing, means for advancing a fastener to a position adjacent the rear of the needle bore with its end-bar transversely disposed to the longitudinal axis of the bore, means for aligning the end-bar with the needle bore, and means for dispensing the end-bar through the bore. Preferably, the apparatus comprises a feed wheel, an aligning means comprising a reciprocating cam slide which also actuates the feed wheel, a dispensing means comprising a plunger carried by a reciprocating support which also actuates the cam slide, and means for reciprocating the support.

In U.S. Pat. No. 4,971,238 which issued on Nov. 20, 1990, there is disclosed a tagger gun type apparatus in which the transverse bar of a tag pin is pushed out of a hollow needle by a piston which is driven by a motor. The motor is coupled to the piston by a rack and pinion and is controlled by a circuit which includes three switches and other componentry.

In commonly assigned U.S. Pat. No. 3,470,834, which issued Oct. 7, 1969, there is disclosed an apparatus for dispensing fasteners which comprises a casing, a needle projecting from the casing, the needle having a central bore, and a plunger slidable back and forth in the bore, the needle comprising an elongated piece of sheet material bent into a tube with its edges spaced apart to provide a longitudinal slot along one side of said bore, the forward end of the needle being pointed and the rearward end having a tail for securing the needle in the aforesaid casing, the diameter of said bore being slightly larger than that of said bar so that the bar may slide lengthwise in the needle with said filament extending through said slot, and the device having a fastener passageway in advance of said plunger when the plunger is retracted.

In commonly assigned U.S. Pat. No. 4,121,487 which issued on Oct. 24, 1978 there is disclosed an apparatus for dispensing fasteners which includes a stepper motor.

In commonly assigned U.S. Pat. No. 3,103,660 issued on Sept. 17, 1963 there is described a tagger gun type apparatus for attaching tags to fabrics with a bar-lock attachment, the apparatus being adapted for utilizing plural assemblies of bar-lock attachments and comprising a hollow needle elongately slotted along one side, a plunger for driving the bar of a bar-lock attachment through the needle with the filament of the attachment projecting through the slot, feeding means for bringing each of an assembly of bar-lock attachments into register with one end of the needle, knife means for severing an attachment which is in register with the needle from an assembly of attachments, and handle means for supporting the needle, the handle means including means for operating the feeding means, the knife means and the plunger in sequence.

Another known tagger gun is the Taggetron 770, an electric powered rechargeable apparatus marketed by Central Notion Co., Inc. of Brooklyn, N.Y. Still another known tagger gun is the Taggetron 880, a modification of the Taggetron 770.

SUMMARY OF THE INVENTION

It is an object of the present invention to provide a new and improved apparatus for dispensing plastic fasteners from fastener stock.

It is another object of the present invention to provide an apparatus as described above which includes an ejector rod for pushing individual plastic fasteners out through a hollow needle and a DC motor for driving the ejector rod.

It is still yet another object of the present invention to provide an apparatus as described above which has a minimal number of parts, is extremely fast, is easy to assemble and is inexpensive to manufacture.

It is a further object of this invention to provide an apparatus as described above which includes a new and novel battery pack for powering the DC motor.

It is still a further object of this invention to provide a new and novel worm for coupling the drive shaft of a DC motor to a worm gear.

An apparatus for dispensing plastic fasteners from a clip of fastener stock constructed according to the teachings of this invention includes a casing, a hollow needle mounted at a front end portion of said casing, said hollow needle having an inlet opening for receiving the cross bar end of a fastener to be dispensed, a guide groove in said casing for receiving the fastener stock, said guide groove being in communication with said inlet opening in said hollow needle, a feeder element for intermittently advancing the fastener stock loaded into said guide groove so that the cross bar of the fastener to be dispensed is loaded into said hollow needle, an ejector rod for pushing the cross bar loaded into the hollow needle through and out of the tip of hollow needle, a DC motor for driving said ejector rod and said feeder element, said DC motor having a drive shaft, a converter assembly for converting rotary motion of the drive shaft of said DC motor into linear motion of said ejector rod, and control means for controlling the operation of said DC motor so as to produce intermittent reciprocating linear movement of said ejector rod.

According to one feature of the invention the converter assembly includes a worm mounted on the drive shaft of the DC motor, a slider, a rack mounted on the slider, a worm gear in engagement with the worm and a spur gear in engagement with the rack and coupled to the worm gear, the converter assembly being constructed so as to provide for overtravel.

According to another feature of the invention the control means includes a pair of switches constructed and arranged so as to collectively operate to either cause rotation of the drive shaft of the DC motor in one direction, cause rotation of the drive shaft of the DC motor in the other direction or stop rotation of the drive shaft of the DC motor.

According to still another feature of the invention the DC motor is powered by a battery pack which is removable and which includes rechargeable batteries. The battery pack is constructed so that the batteries can be recharged while the battery pack is either in the casing of the apparatus or removed from the casing.

According to a further feature of the invention, one of the switches in the control means is actuated by an actuator button moved by or integral with a slide bar which is moved by the slider.

According to still a further feature of the invention a worm is provided for coupling a DC motor to a worm gear which is made up of two parts loosely interconnected so as to allow the DC motor to get up to high speed very quickly and with very little torque.

According to still a further feature of the invention an arrangement is provided for manually moving the slide bar in the event of a jam in the internal mechanism of the apparatus.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF PREFERRED EMBODIMENTS

Figure 1:
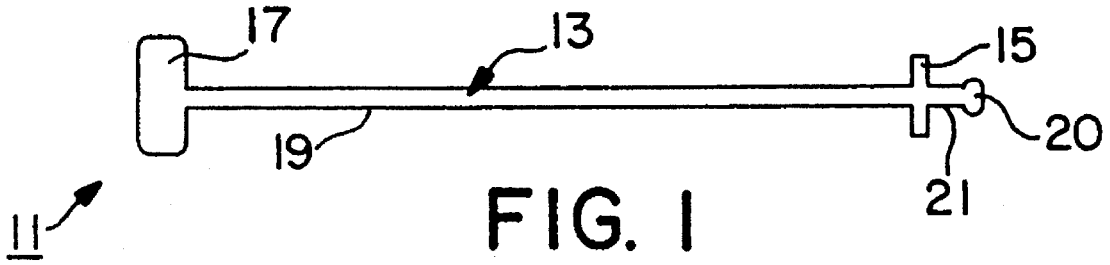
FIGS. 1 and 2 are side and front views, respectively, of a clip of fastener stock which may be used with the apparatus of this invention.
Figure 2:
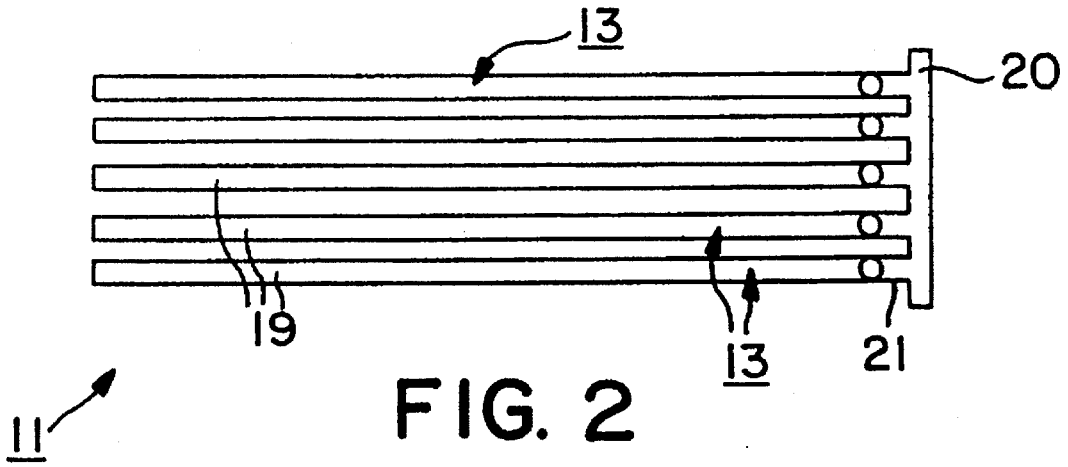

Referring now to the drawings, there are shown in FIGS. 1 and 2 side and front views, respectively, of a length of one type of known fastener stock, the fastener stock being identified by reference numeral 11. As can be seen, fastener stock 11 includes a plurality of individual fasteners 13, each having a cross bar 15 at one end, a paddle 17 at the other end and a thin filament 19 connecting the two ends. Each fastener 13 is coupled to a common runner 20 through a short connector filament 21 at the cross bar end of the fastener 13. Clip 11 is made of a plastic such as nylon, polyethylene or polypropylene.

Figure 3:
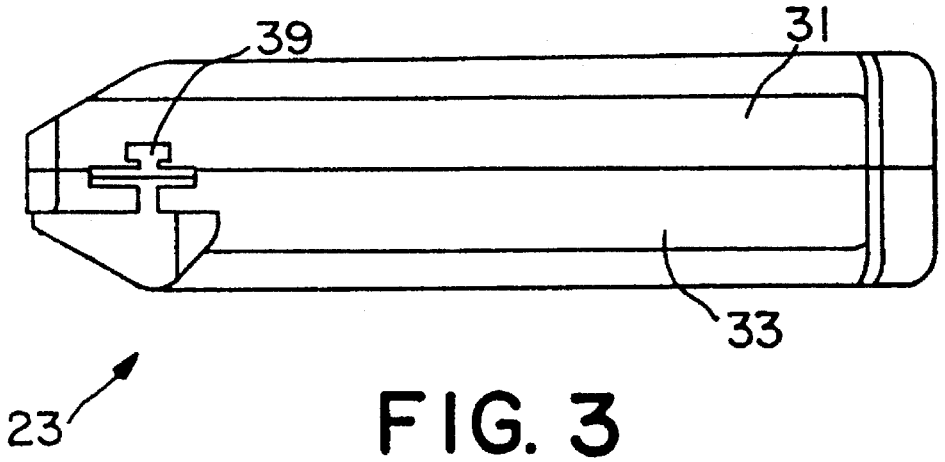
FIGS. 3 and 4 are top and side views, respectively, of an apparatus constructed according to this invention for dispensing plastic fasteners using the clip of fastener stock shown in FIGS. 1 and 2.
Figure 4:
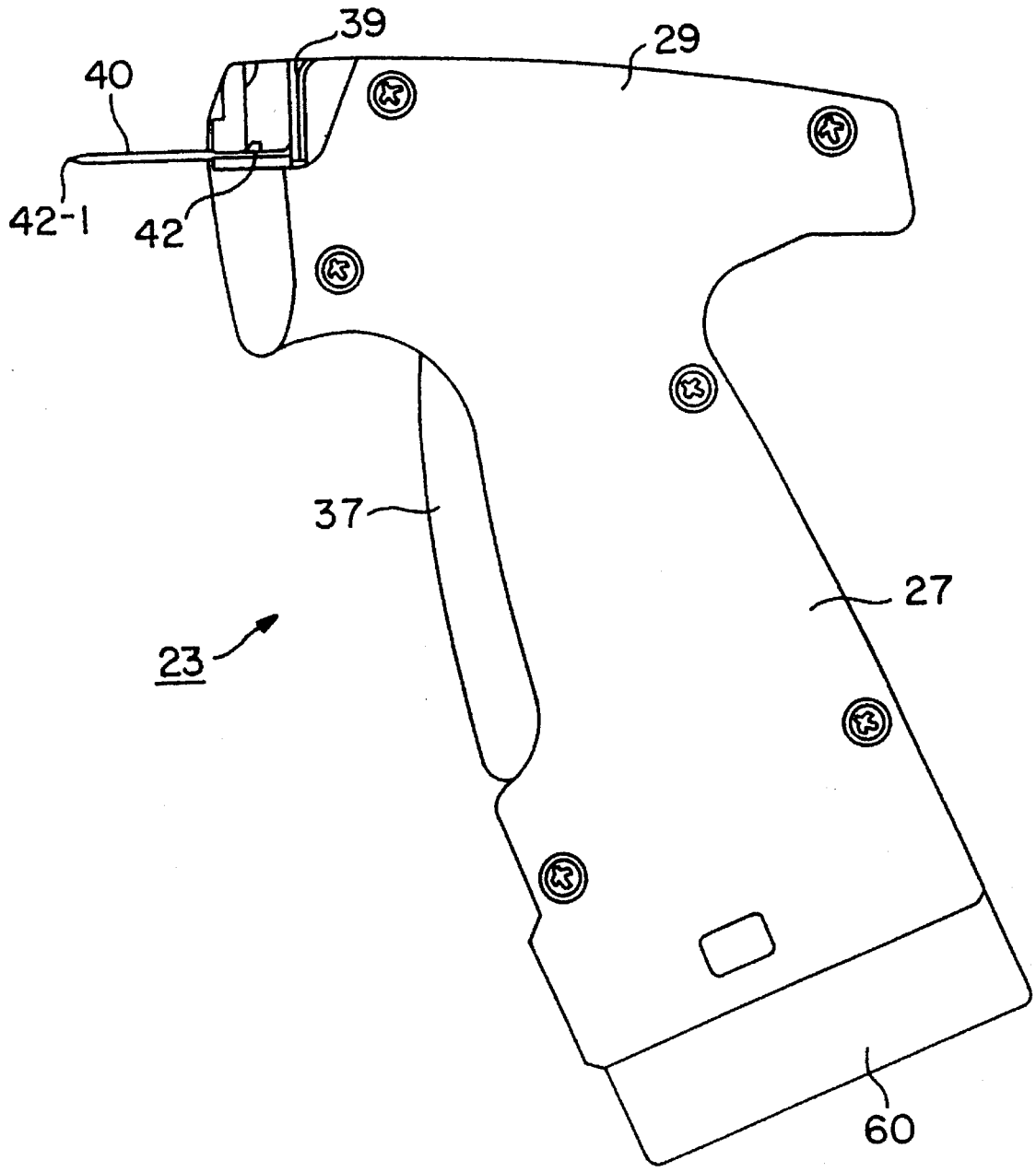
Figure 5:
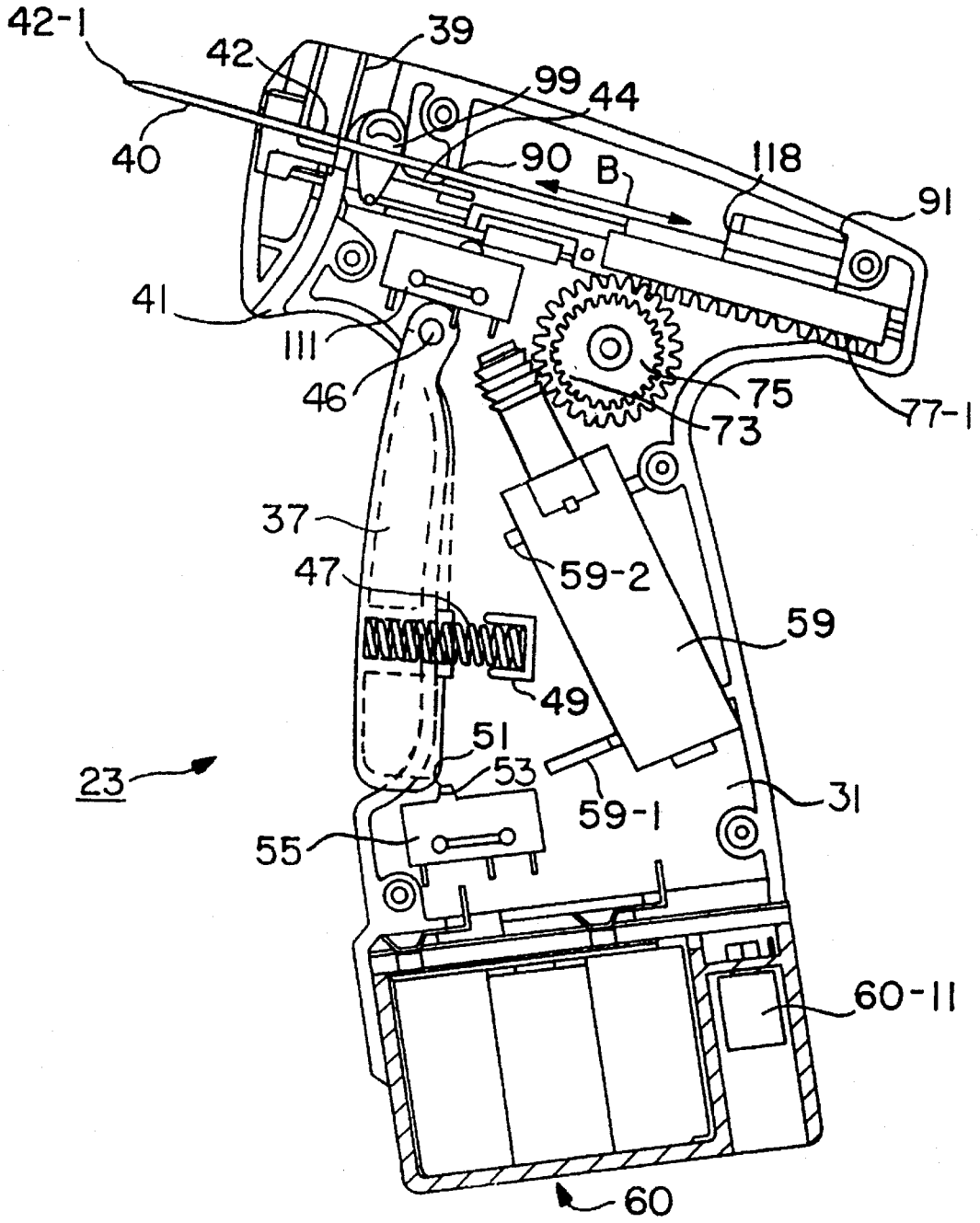
FIG. 5 is a view illustrating the internal construction of the apparatus of this invention.
Figure 5A:
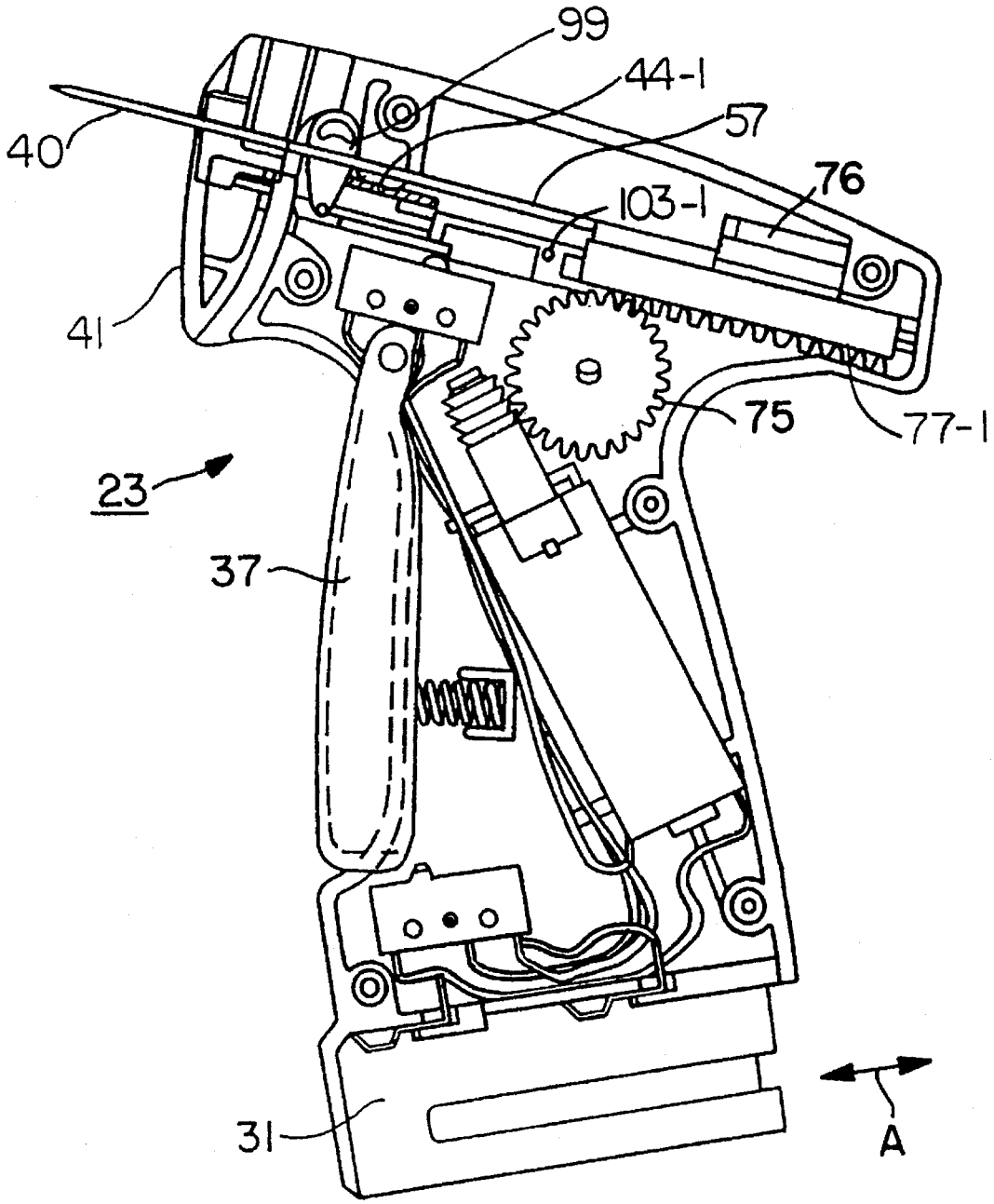
FIG. 5A is a perspective view of the apparatus as shown in FIG. 5 without the battery pack and the link connecting the slide bar to the feeder element.
Figure 6A:
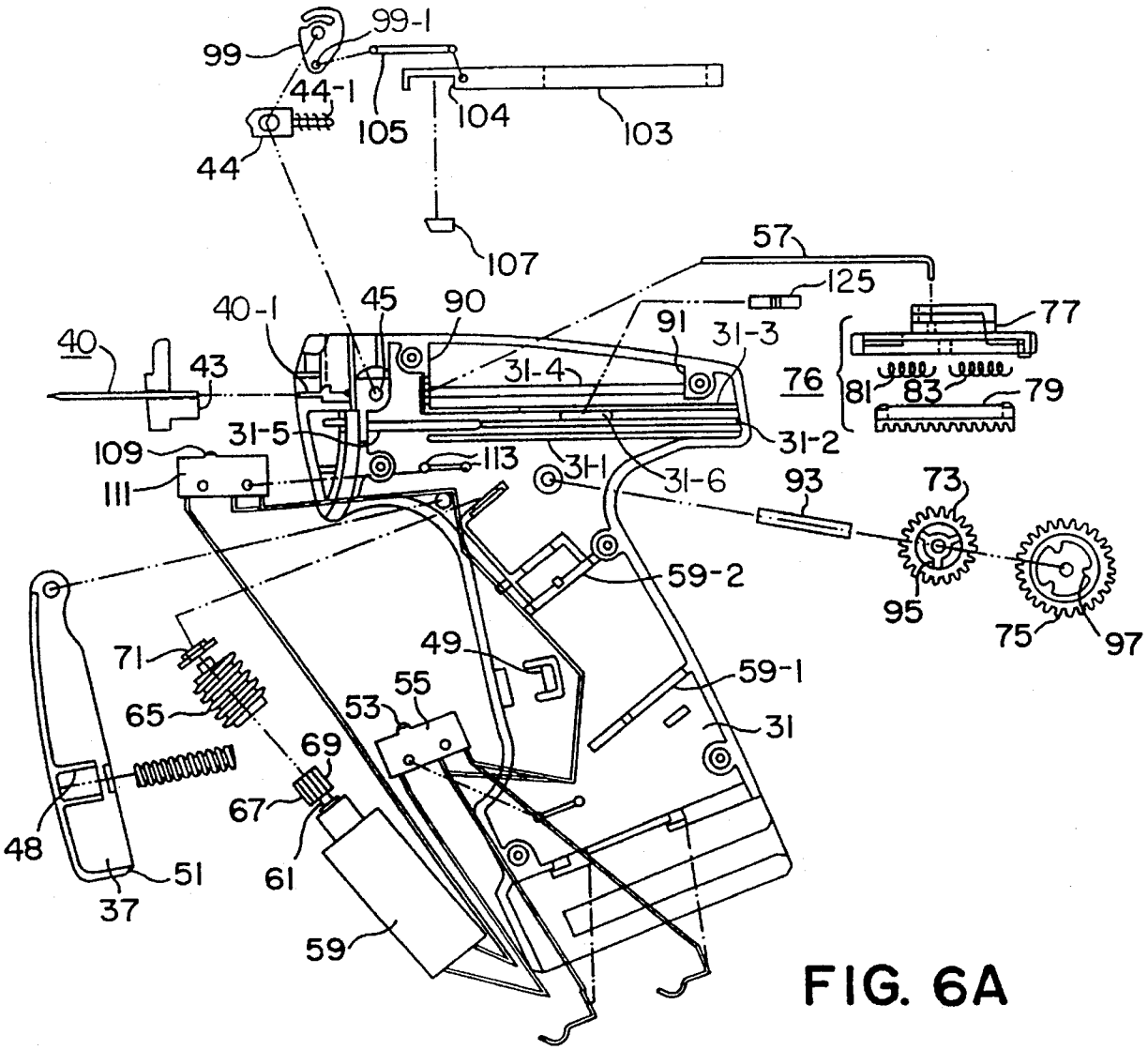
FIGS. 6A and 6B taken together are an exploded view of the apparatus of this invention.
Figure 6B:
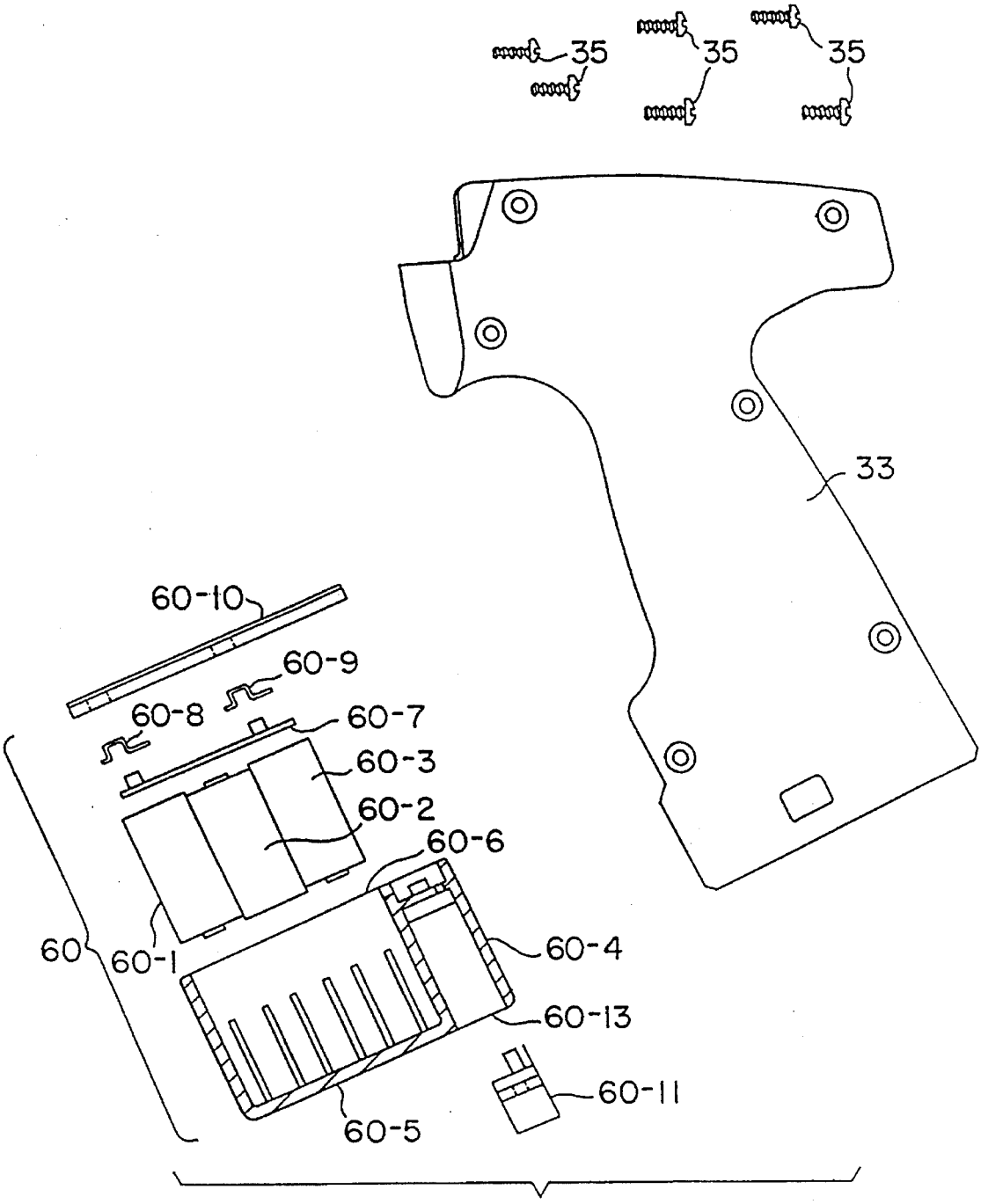
Figure 6C:
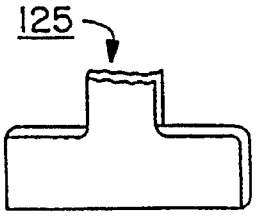
FIG. 6C is an enlarged perspective view of the release button shown in FIG. 6A.
Figure 6D:
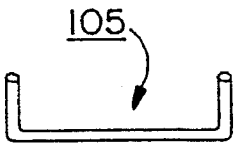
FIG. 6D is an enlarged perspective view of the link shown in FIG. 6A.

Referring now to FIGS. 3 and 4., there are shown top and side views, respectively, of an apparatus constructed according to this invention for dispensing plastic fasteners 13 from fastener stock 11, the apparatus being identified by reference numeral 23. The internal structure of apparatus 23 is shown in FIGS. 5, 5A and 6A through 6C and 7A through 7D.

Apparatus 23 includes a hollow gun-shaped casing 25 having a handle portion 27 and a barrel portion 29. Casing 25 is formed of a right half 31 and a left half 33. Body half 31 includes five elongated ribs 31-1, 31-2, 31-3, 31-4 and 31-5. Halves 31 and 33 may be fabricated from any convenient material, such as molded plastic and are joined together by screws 35. Alternatively, halves 31 and 33 may be joined together by a snap-fit, by sonic welding, by gluing, by riveting or the like. Apparatus 23 is hand actuated by a lever type trigger 37 located at the front of handle portion 27. A guide groove 39 is formed in the top of barrel portion 29 into which fastener stock 11 is inserted. A hollow needle 40 is removably mounted in an opening 40-1 at the front end 41 of barrel portion 29. Needle 40 includes an inlet opening 42 for receiving the cross bar 15 of a fastener 13. In the operation of apparatus 23, fastener stock 11 is inserted into groove 39 of apparatus 23. The cross bar 15 of a fastener 13 to be dispensed is fed into needle 40 through inlet opening 42 and is then pushed out through tip 42-1 of needle 42 as will hereinafter be described. Needle 40 includes a knife edge 43 at the back which serves to separate a fastener 13 from the fastener stock 11 as it is fed into hollow needle 40. An antiback 44 is pivotally mounted on a pin 45 on casing 25 to prevent fastener stock 11 from backing up in guide groove 39 up during the feed operation.

Trigger 37 is pivotally mounted on a pivot pin 46 integrally formed on right half 31 of casing 25. Trigger 37 is held biased outward by a compression spring 47 sandwiched between a U shaped rib 48 formed in handle portion 27 and a U shaped rib 49 formed in right half 31 of casing 25. When trigger 37 is pushed in, projection 51 at the bottom of trigger 37 will hit up against and push in a button 53 on a first switch 55.

An L-shaped ejector rod 57 is provided for pushing cross bars 15 of fasteners 13 out through hollow needle 41, one at a time. Ejector rod 57 is driven by a DC motor 59 which is mounted on supports 59-1 and 59-2 integrally formed on right half 31 of casing 25. DC motor 59 is powered by a removable battery pack 60.

Figure 7A:
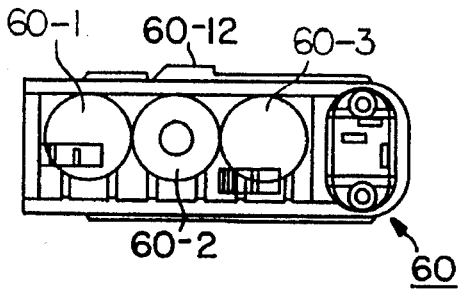
FIGS. 7A, 7B and 7C are bottom, right side and perspective views, respectively of the battery pack in FIG. 5, the bottom wall of the casing of the battery pack being removed in FIG.7A.
Figure 7B:
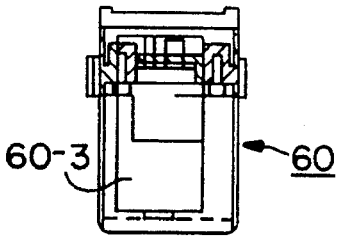
Figure 7C:
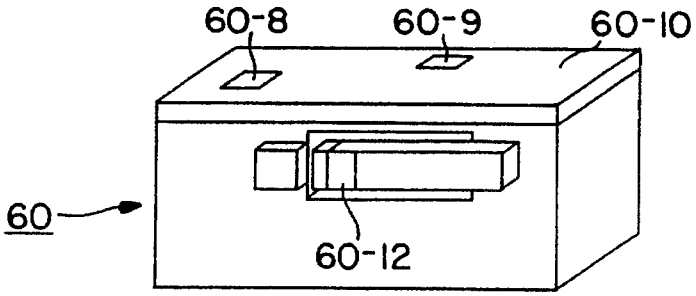

Battery pack 60, which is shown separately in FIGS. 7A through 7C, includes a set of batteries 60-1, 60-2 and 60-3 which are disposed inside a generally box shaped container 60-4 having a bottom wall 60-5 and an open top 60-6, a spacer 60-7, a pair of terminals 60-8 and 60-9, a cover plate 60-10 and a switch type charging receptacle 60-11. Cover plate 60-10 is secured to the top of the box shaped container 60-4 by an adhesive or any other suitable means such as screws. Battery pack 60 is slidably mounted into casing 25 from the back as shown by arrows A in FIG. 5A. An elongated generally rectangular flexible tab 60-12 on container 60-4 holds battery pack 60 in place in casing 25. Charging receptacle 60-11 is accessed through an opening 60-13 extending in from bottom 60-5. Charging receptacle 11 includes a normally closed negative terminal 60-14, a fixed negative terminal 60-15 and a fixed positive terminal 60-16.

Figure 7D:
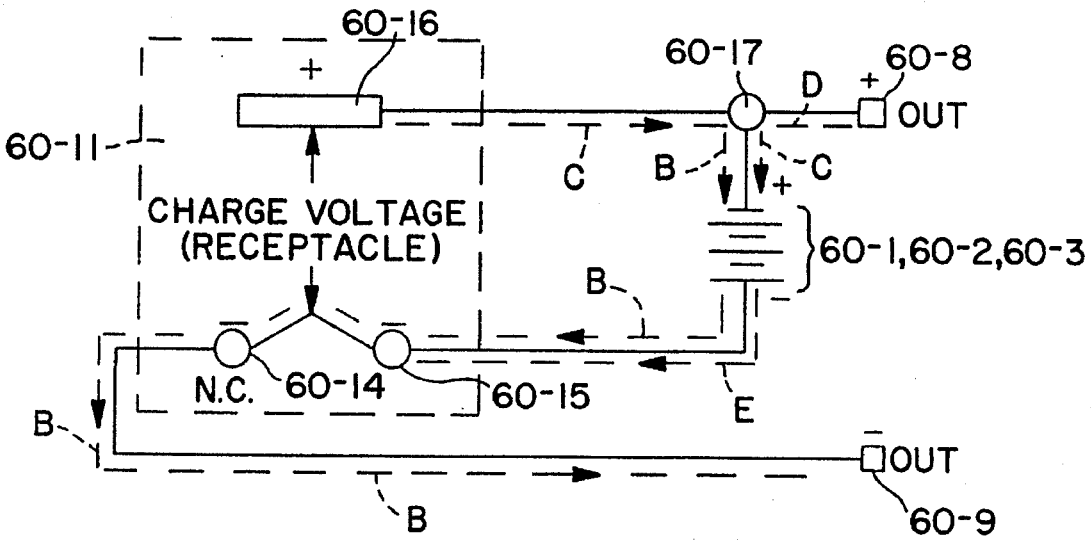
FIG. 7D is a Circuit diagram for the battery pack shown in FIG. 5.

A circuit diagram for battery pack 60 is shown in FIG. 7D.

When battery pack 60 is not being charged i.e. the plug of a charging device (not shown) is not inserted into charging receptacle 60-11, terminal 60-14 is closed and batteries 60-1, 60-2 and 60-3 will be coupled in to output terminals 60-8 and 60-9 through junction 60-17 on one side and contacts 6-14 and 60-15 on the other side as shown by dashed lines D. When the plug of a charging device is inserted into receptacle 60-11, normally closed negative contact 60-14 will be pushed open and batteries 60-1, 60-2 and 60-3 will be coupled to the charging device through a path including positive terminal 60-16 and junction 60-17 on one side and negative terminal 60-15 on the other side as shown by dashed lines E. When the plug of the charging device is so inserted into charging receptacle 60-11, batteries 60-1, 60-2 and 60-3 will not be coupled to output terminals 60-8 and 60-9.

As can be appreciated, battery pack 60 can be recharged either while it is in casing 25 or is removed from casing 25.

Figure 7E:
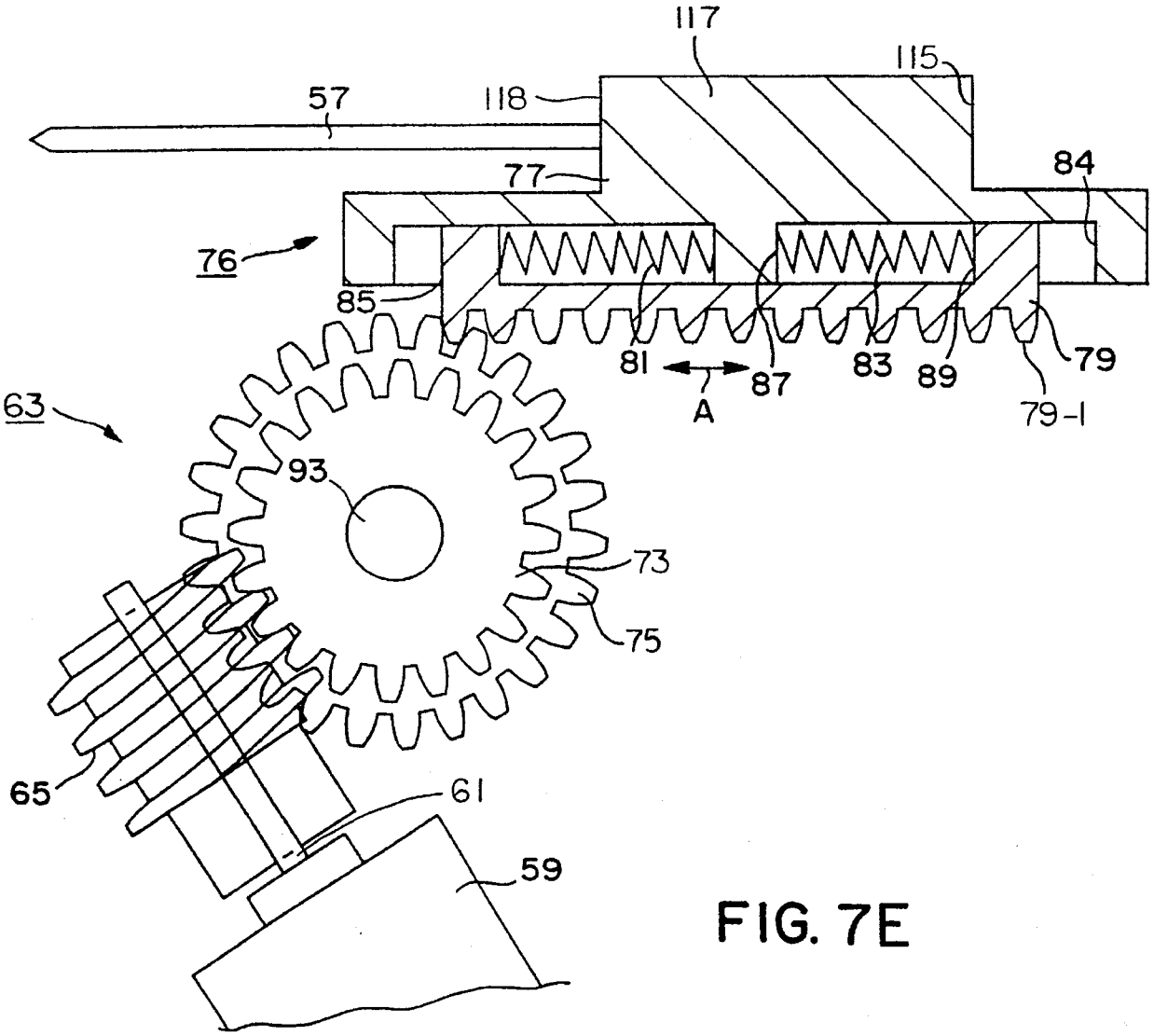
FIG. 7E is an enlarged pictorial view of the converter assembly, ejector rod and DC motor shown in FIGS. 5 and 6.
Figure 8:
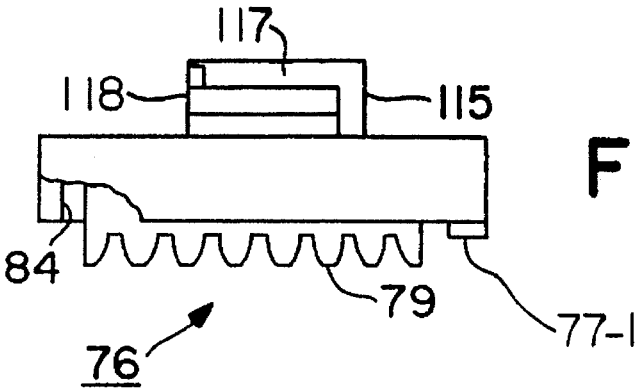
FIGS. 8, 9, 10 and 11 are front, top side and bottom views, respectively, of the slider assembly in the apparatus of this invention, FIG. 8 being broken away in part.
Figure 9:
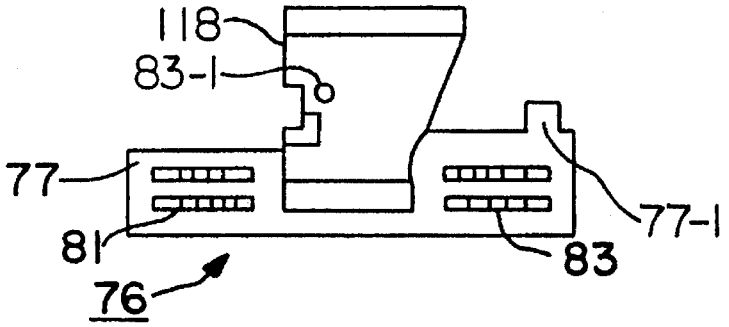
Figure 10:
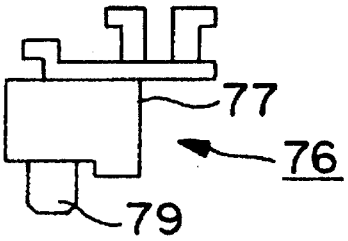
Figure 11:
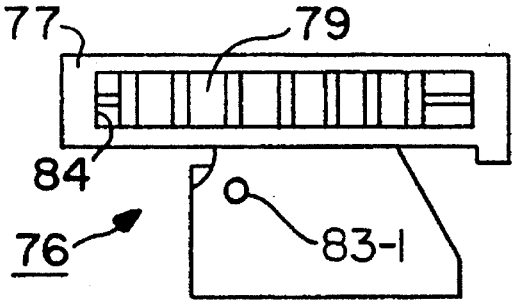
Figure 12:
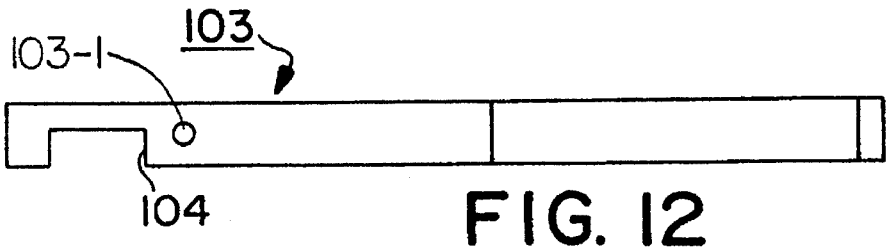
FIG. 12, 13 and 14 are front, top and side views, respectively, of the slide bar in the apparatus of this invention.

Rotation of the drive shaft 61 of DC motor 59 is converted into linear movement of ejector rod 57 by a converter assembly 63. Rotation of drive shaft 61 is reversed to produce reciprocating linear movement of ejector rod 57 by a switch arrangement as will be later described. An enlarged pictorial view of converter assembly 63, ejector rod 57 and DC motor 59 is shown in FIG. 7E.

Converter assembly 63 includes a worm 65 mounted on a first bushing 67 fixedly attached to the front end of drive shaft 61 of DC motor 59, a second bushing 71 slidably mounted on a tip 72 on worm 65 for use in holding DC motor 59 in place in casing 25, a worm gear 73 in engagement with worm 65, a spur gear 75 in engagement with worm gear 73 and a slider assembly 76. Rotational movement of worm 65 relative to bushing 67 is prevented by a set of splines 68 formed on the outer surface of bushing 67 which engage a set of splines (not shown) on the inner surface of worm 65.

Separate views of slider assembly 76 are also shown in FIGS. 8 through 11. Slider assembly 76 includes a slider 77, a rack 79 and a pair of compression springs 81 and 83. Ejector rod 57 is mounted in a hole 83-1 in slider 77. Thus, back and forth movement of slider 77 will result in back and forth movement of ejector rod 57. Rack 79 is snap-fit into a recess 84 in slider 77. Rack 77 is slidably movable in recess 84 in slider 77 as shown by arrows A in FIG. 7 and is in engagement with spur gear 75 unless disengaged as will hereinafter be explained. Slider 77 is mounted in casing 25 for slidable movement back and forth within barrel portion 29 along rib 31-4 on body half 31 as shown by arrows B in FIG. 5. Movement of rack 79 in slider 77 is restricted by compression springs 81 and 83. Compression spring 81 is disposed inside rack 79 between a stop 85 at the front end of rack 79 and a center post 87 on slider 77. Compression spring 83 is disposed inside rack 79 between a stop 89 at the rear end of rack 79 and center post 87.

Forward movement of slider 77 in casing 25 is limited by a front stop 90 integrally formed in right half 31 of casing 25 while rearward travel of slider 77 is limited by a rear stop 91 formed in right half 31 of casing 25. In order to prevent jamming of the gears at each end of travel of slider 77, rack 79 is sized to provide for overtravel. In particular, the number of teeth and length of rack 79 is such that rack 79 will disengage from spur gear 75 (i.e. run out of teeth) at the end of its travel in each direction. Momentum will cause continued movement of rack 79 within slider 77, independent of spur gear 75. Reengagement of rack 79 with spur gear 75 is achieved by compression springs 81 and 83 as will also hereinafter be explained in more detail.

Worm gear 73 and spur gear 75 are each rotably mounted on a shaft 93 which is fixedly mounted in right half 31 of casing 25. Worm gear 73 is located behind spur gear 75. For clarity, spur gear 75 is broken away partly in FIG. 5 to show worm gear 73. Worm gear 73 and spur gear 75 are coupled together for movement by a set of splines 95 integrally formed on the front side of worm gear 73 and which face and interlock in a loose manner with a set of splines 97 integrally formed on one side of spur gear 75. The loose interconnection of worm gear 73 to spur gear 75 allows for overtravel of worm gear 73 relative to spur gear 75. This overtravel enables motor 59 to drive spur gear 75 to a high speed very quickly and with very little torque. The overtravel is realized by sizing and spacing the splines on each gear so worm gear 73 will have to rotate at least a few degrees in either direction before its splines hit up against the splines in the spur gear 75 and cause spur gear 75 to rotate with it.

A reciprocating feed pawl 99 for advancing fastener stock 11 loaded into guide groove 39 is rotably mounted on pin 45 in front of antiback 44. Feed pawl 99 is driven by a slide bar 103 which is coupled to feed pawl 99 by a generally U-shaped link 105. One end of link 105 is mounted in a hole 103-1 in slide bar 103 and the other end of link 105 is mounted in a hole 99-1 in feed pawl 99. Slide bar 103 is disposed within barrel portion 29 of apparatus 23 between ribs 31-1 and 31-3 of body half 31 and is movable back and forth by slider 77. An actuator 107 is disposed in a recess 104 in slide bar 103 for depressing a button 109 on a second switch 111 which is mounted on pins 113 integrally formed on right half 31 of casing 25. Slide bar 103 is shaped to further include a recess 103-2 having a front wall 103-3 and a back wall 103-4 and a projection 103-5. Slider 77 includes a projection 77-1 which is used to move slide bar 103 back and forth as will hereinafter be explained. Actuator 107 is sized smaller than recess 104 so that it can move back and forth a small amount in recess 104 to provide for additional overtravel.

The mechanism in gun 23 operates in the following manner.

Figure 13:
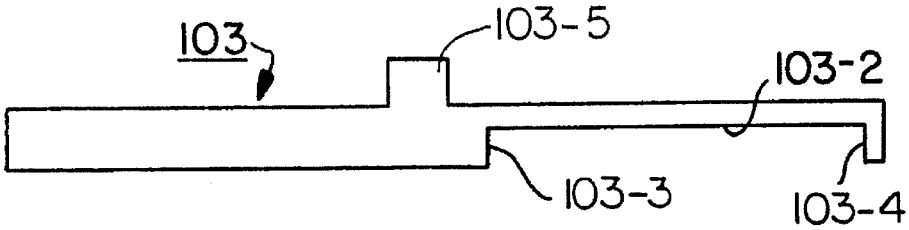
Figure 14:
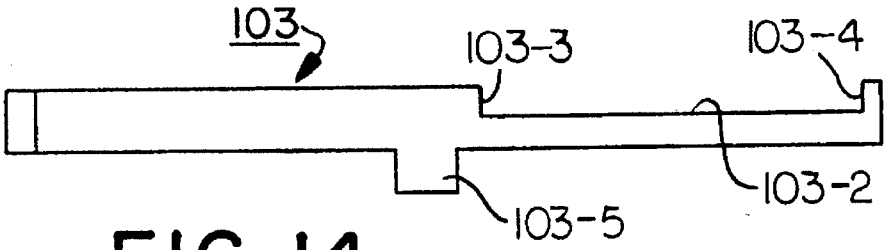
Figure 15A:
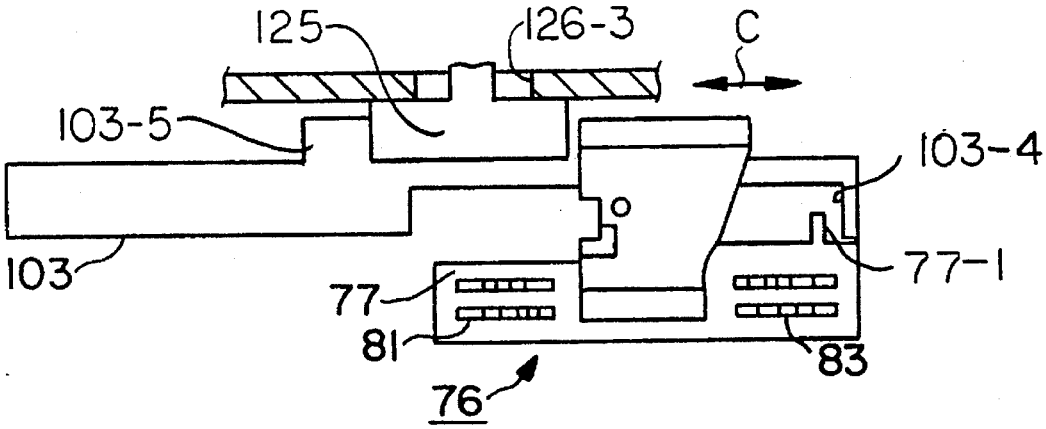
FIG. 15A is a simplified top view of the slider and slide bar in FIG. 15.
Figure 15:
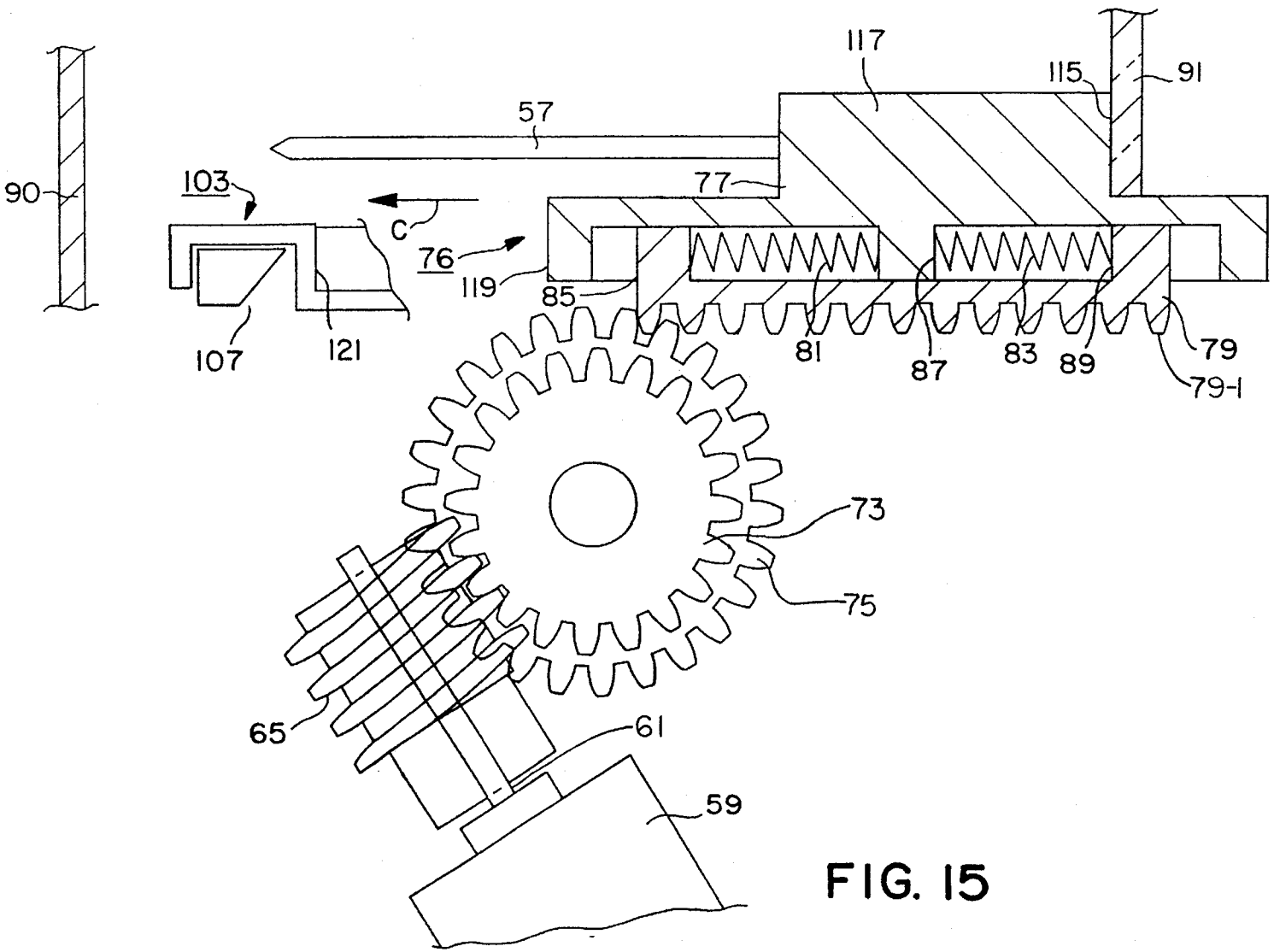
FIG. 15 is a fragmentary top view of a portion of the apparatus of this invention.

When the mechanism in gun 23 is at rest in a "home" position, as shown in FIG. 15, rear end 115 of a top projection 117 on slider 77 is abutting rear stop 91 in casing 25. As drive shaft 61 of DC motor 59 rotates clockwise slider 77 is moved in a forward direction as indicated by arrow C in FIGS. 15 and 15A. When projection 77-1 on slider 77 comes into contact with front 103-3 of recess 103-2 on slide bar 103 it will cause slide bar 103 to also advance in a forward direction causing feed pawl 99 to rotate about pin 45 in a forward direction, pushing fastener stock 11 down into guide groove 39. Slider 77 will move forward until front end 118 of top projection 117 hits front stop 90. Rotation of drive shaft 61 in a counterclockwise direction will cause slider 77 to return to its original position. As slider 77 moves back, projection 77-1 will hit up against rear projection 103-4 on slide bar 103, (see FIGS. 13 and 14), and carry slide bar 103 back with it to its original position.

Figure 16:
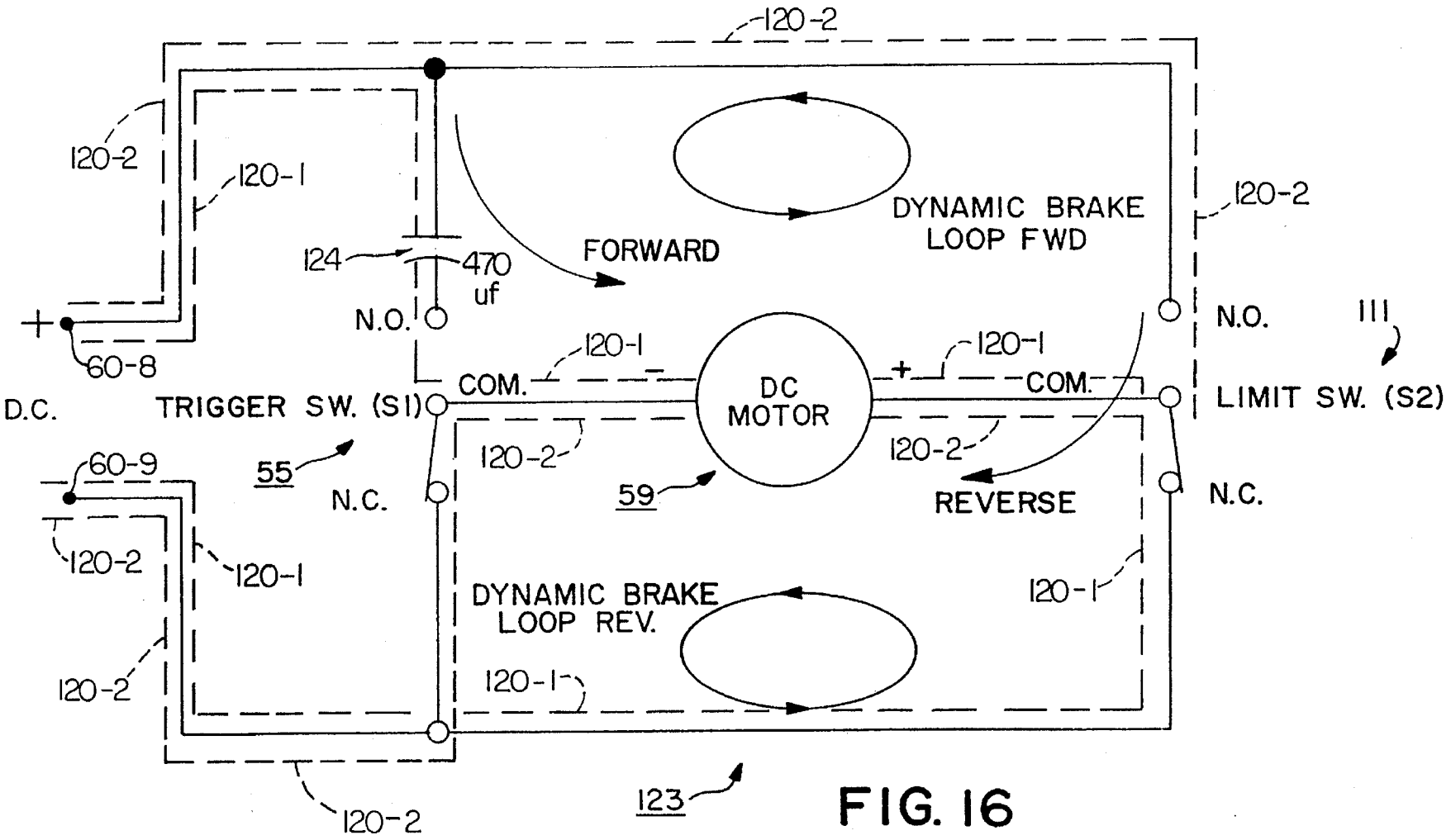
FIG. 16 is a circuit diagram of the electrical portion of the apparatus of this invention.

The operation of the electric circuit portion of apparatus 23 can be best understood with reference to FIG. 16.

As can be seen, the electric circuit, identified by reference numeral 123, comprises first switch 55, DC motor 59 and second switch 111. First switch 55 and second switch 111 are both normally closed, single pole, double throw switches. The common terminal 55-1 of switch 55 is connected to the negative terminal of DC motor 59 while the common terminal 111-1 of switch 111 is connected to the positive terminal of DC motor 59. A capacitor 124 is coupled in parallel with battery input terminals 60-8 and 60-9 to provide a more efficient use of the current.

With switches 55 and 111 in their normally closed position there is no current flowing through DC motor 59. When trigger 37 is squeezed, projection 51 at the bottom of trigger 37 will depress button 53 on first switch 55 causing switch 55 to move from a normally closed position to a normally open position. This will cause current to flow through DC motor 59 in a path shown by dashed lines 120-1. This current flow through DC motor 59 will cause shaft 61 of motor 59 to rotate in a clockwise direction which in turn will cause slider 77 to move in a forward direction toward the front end of barrel portion 29, eventually engaging and carrying with it slide bar 103.

Just before slider 77 hits stop 90, detent 107 on slide bar 103 will push down against and depress the actuator button 115 on switch 111 causing switch 111 to move from a normally closed state to a normally open state.

At the same time as slider 77 hits stop 90, the last tooth 79-1 on rack 79 will be in engagement with spur gear 75. Continued movement of rack 79 in a forward direction, will be free movement since rack 77 is no longer coupled to spur gear 75. This movement will compress spring 81. Since spring 81 is a compression spring it will tend to reextend, pushing rack 79 back to its position prior to any free movement so that the first tooth on rack 79 is reengaged with spur gear 75.

With switch 55 in an open position and switch 111 in an open position there will be a dynamic braking loop which will quickly bring motor 59 to a stop.

Upon release of trigger 37, switch 55 will return to a normally closed position and current will flow through motor 59 in a path shown by dashed arrows 120-2 causing drive shaft 61 of motor 59 to rotate counterclockwise. This in turn will cause slider 77 to return to its original "home" position carrying with it slide bar 103. As slide bar 103 moves back it will release switch button 109 returning switch 111 to a normally closed position. Slider 77 will stop when it hits rear stop 91. Momentum will cause continued free movement of rack 79. Compression spring 83 will push rack 79 back into engagement with spur gear 75.

As can be appreciated, once motor 59 is rotating clockwise causing slider to move in a forward direction it will not be reversed until button 109 on switch 111 is depressed. However, button 109 will not be depressed unless slider 77 moves forward sufficiently so that it engages slide bar 103 and carries slide bar with it so that actuator 107 can contact button 109 and push button 109 down. In the event of a jam, such as by misalignment of a fastener in the needle, slider 77 may be prevented from moving forward to the point where slide bar 103 is moved sufficiently forward so that actuator 107 can depress button 109. To solve this problem a release button 125 is provided. Button 125 enables a user to manually push slide bar 103 forward so that actuator 107 can be brought into contact with button 109 and push button 109 down. Button 125 includes a base 125-1 and a projection 125-2. Base 125-1 is slidably mounted in body half 31 between ribs 31-2 and 31-3 in back of projection 103-5 on slide bar 103. Projection 125-2 extends up through a longitudinal slot 31-6 in body half 31 (See FIG. 15A). When button 125 is pushed forward, base 125-1 will hit up against projection 103-5 on slide bar 103 and push slide bar 103 forward to the point where actuator 107 pushes button 109 down. Once this occurs motor 59 will be reversed moving slider 77 and hence ejector rod 59 back away from needle 40. Needle 40 can then be easily removed from apparatus 23 and the fastener causing the jam removed from needle 40.

Instead of one single pole double throw switch, switch 55 could be replaced by a pair of single pole single throw switches, one normally open and the other normally closed, with both switches being mechanically ganged together. Switch 111 could also be replaced by a pair of single pole single throw switches constructed and coupled together to function as switch 111.

Also, instead of shortening the rack to disengage the motor and drive gear from the slider at the end of its limited travel, overtravel can be achieved removing an arcuate segment of teeth from the spur gear or by providing for alternate engagement and disengagement of the spur and worm gears radially at a common pressure point using a spring loaded projection on one of the gears and a detent on the other gear.

Figure 17:
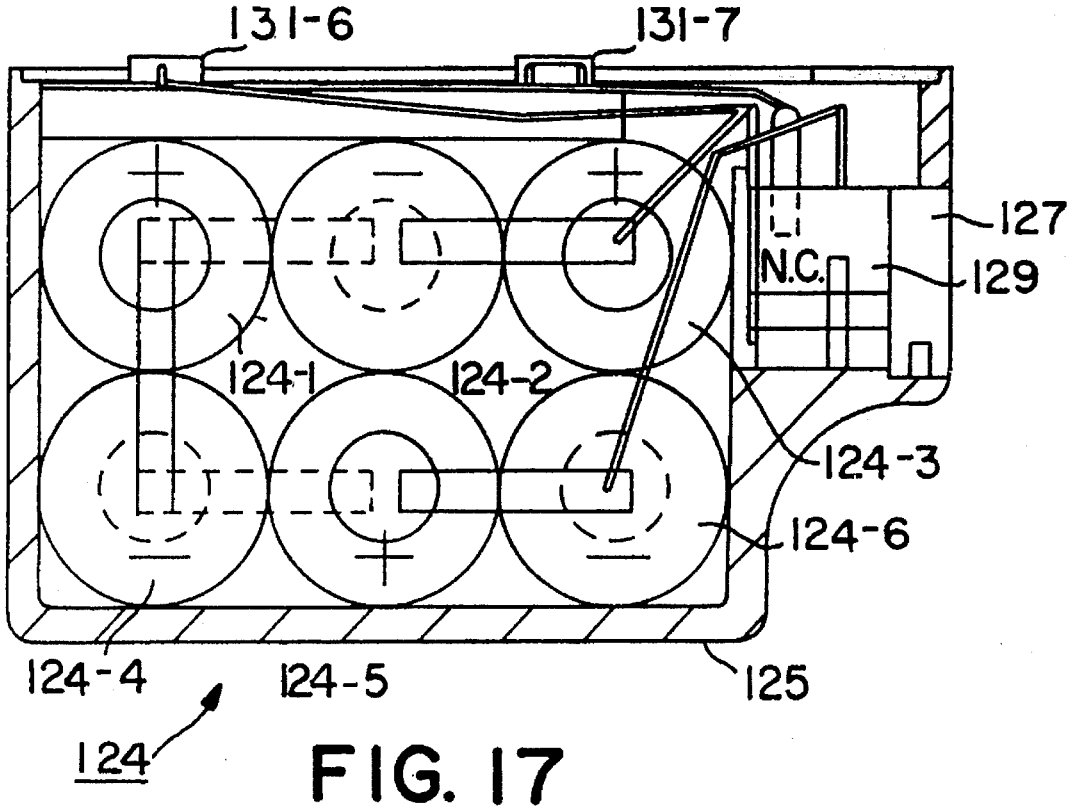
FIGS. 17, 18 and 19 are front section, top and side views of another embodiment of the battery pack in the apparatus of this invention.
Figure 18:
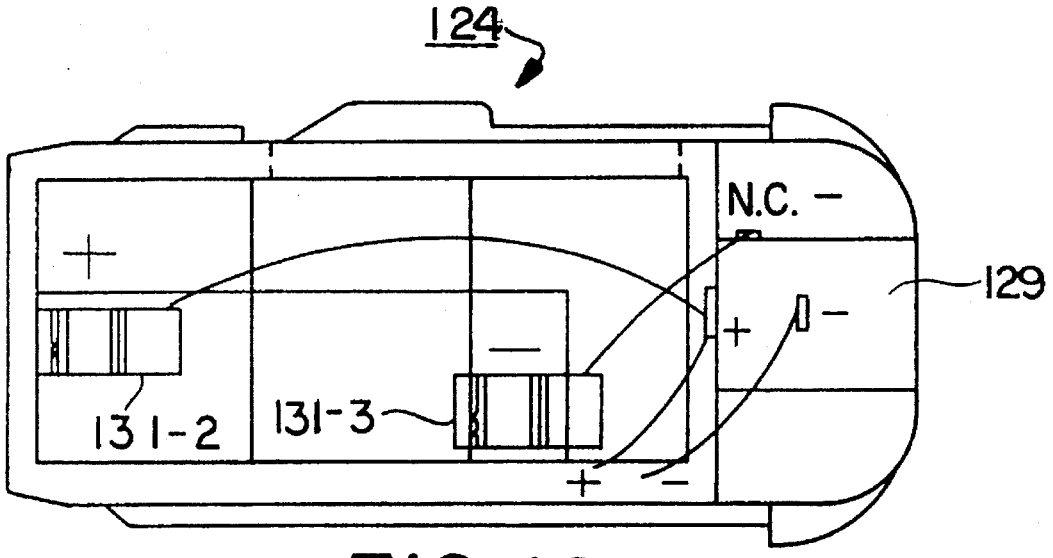
Figure 19:
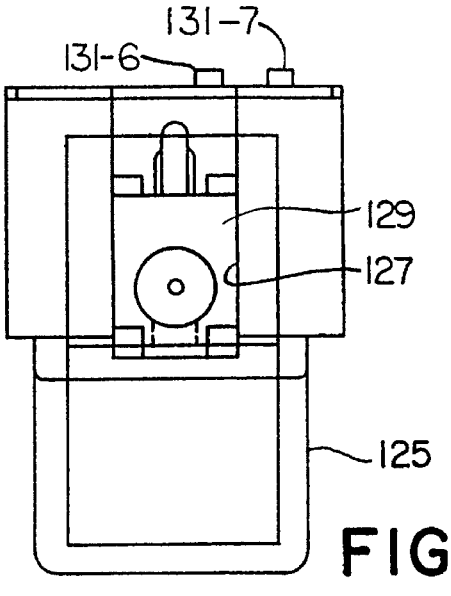
Figure 20:
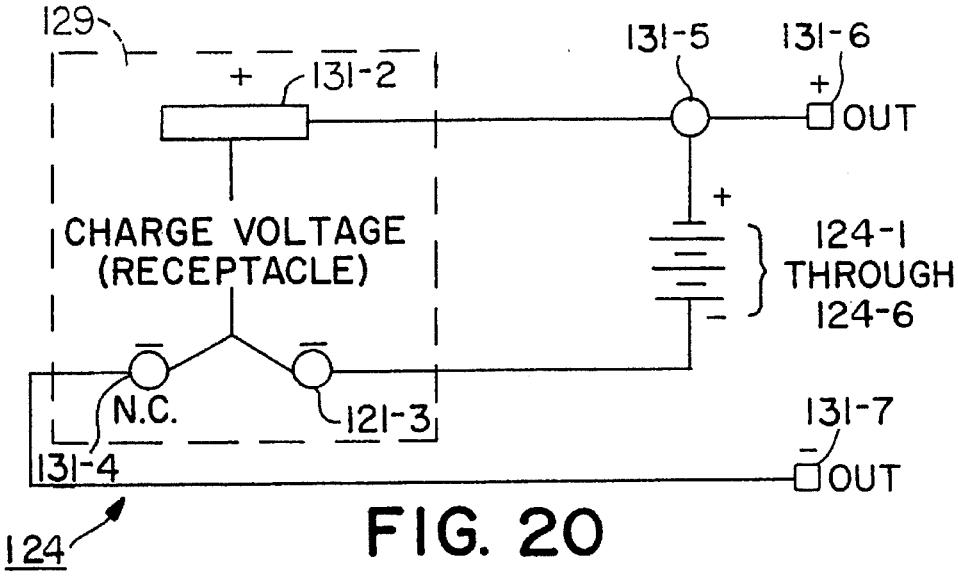
FIG. 20 is circuit diagram for the battery pack in FIG. 17.

In FIGS. 17-19 are shown front, top and side views of a modification of battery pack 60, the modification being identified by reference numeral 124. Battery pack 124 includes 6 batteries 124-1 through 124-6 which are stacked horizontally rather than vertically. Battery pack 124 includes a container 125 having an opening 127 in the side in which is disposed a switch type charging receptacle 129. The circuit diagram for battery pack 124 is shown in FIG. 20. The circuit includes charge voltage receptacle 129. Receptacle 129 has a positive terminal 131-2, a fixed negative terminal 131-3 and a normally closed terminal 131-4. Circuit also includes a junction 131-5, output terminals 131-6 and 131-7. Circuit 124 operates the same way as in battery pack 60. Battery pack 124 is charged through receptacle 129.

Figure 21:
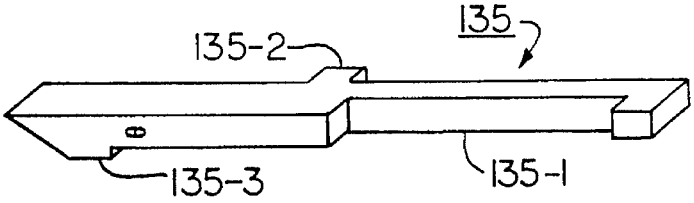
FIG. 21 is a perspective view of a modification of the actuator and slide bar shown in FIG. 5A.

Instead of being separate elements, actuator 107 and slide bar 103 can be made a unitary structure, if so desired. An example of a combined actuator and slide bar is shown in FIG. 21 and identified by reference numeral 135. Combination actuator and slide bar 135 is an elongated member shaped to include a recess 135-1 similar to projection 135-2 similar to projection 135-2 similar to projection 103-5. However, instead of recess 104, combination slide bar and actuator 135 includes a projection 135-3 for depressing button 109 on switch 111.

Figure 22:
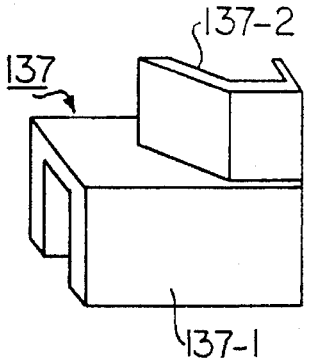
FIG. 22 is a perspective view of a modification of the actuator shown in FIG. 5A.

In FIG. 22 there is shown an enlarged view of a modification of actuator 107, the modified actuator being identified by reference numeral 137. Actuator 137 includes a channel shaped base 137-1 and a projection 137-2. Base 137-1 rides on rib 31-5 while projection 137-2 will depress button 109 when actuator 137 is properly positioned.

Figure 23:
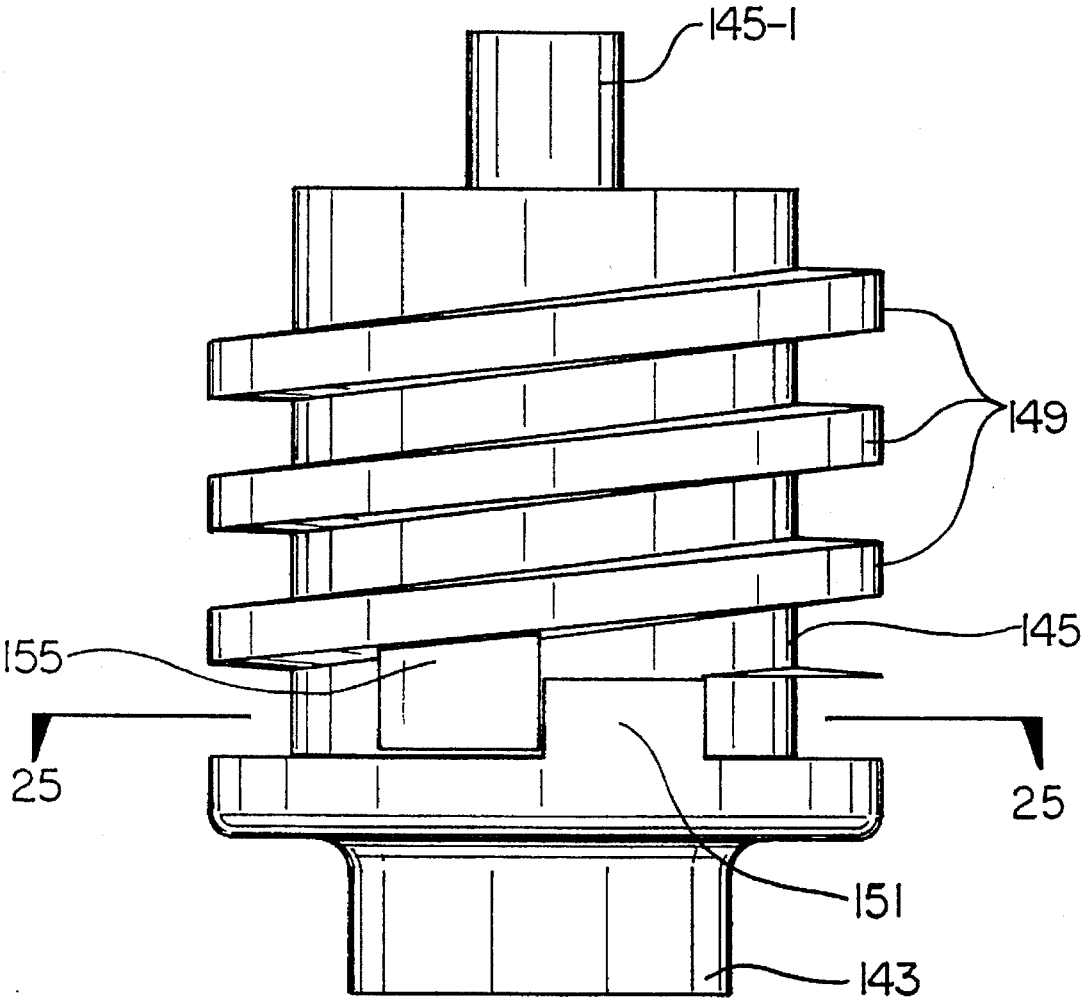
FIG. 23 is an enlarged front elevation view of another embodiment of a worm for use in the apparatus of this invention for coupling the electric motor to the worm gear.
Figure 24:
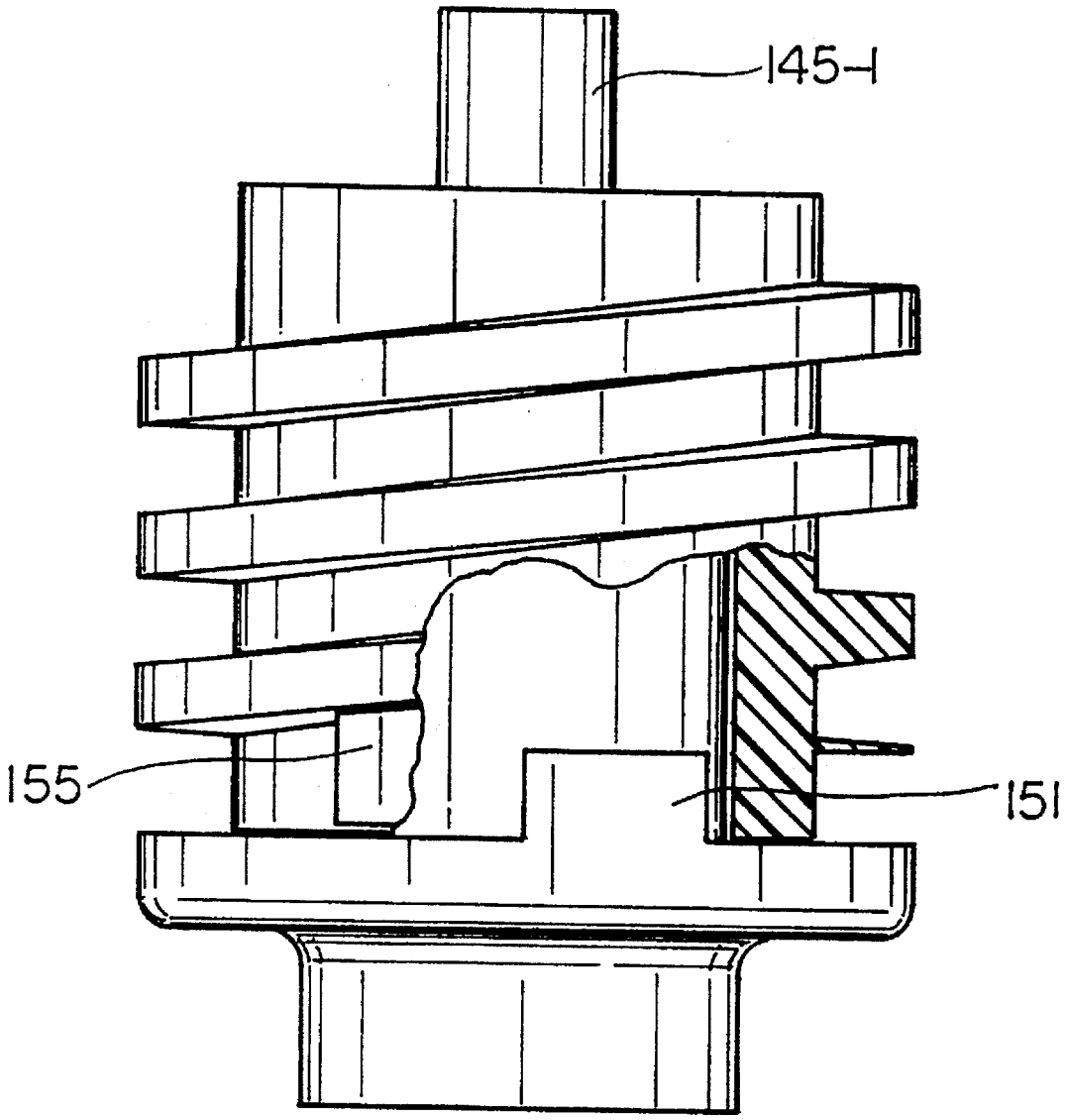
FIG. 24 is an enlarged front elevation view partly broken away of the worm shown in FIG. 23.
Figure 25:
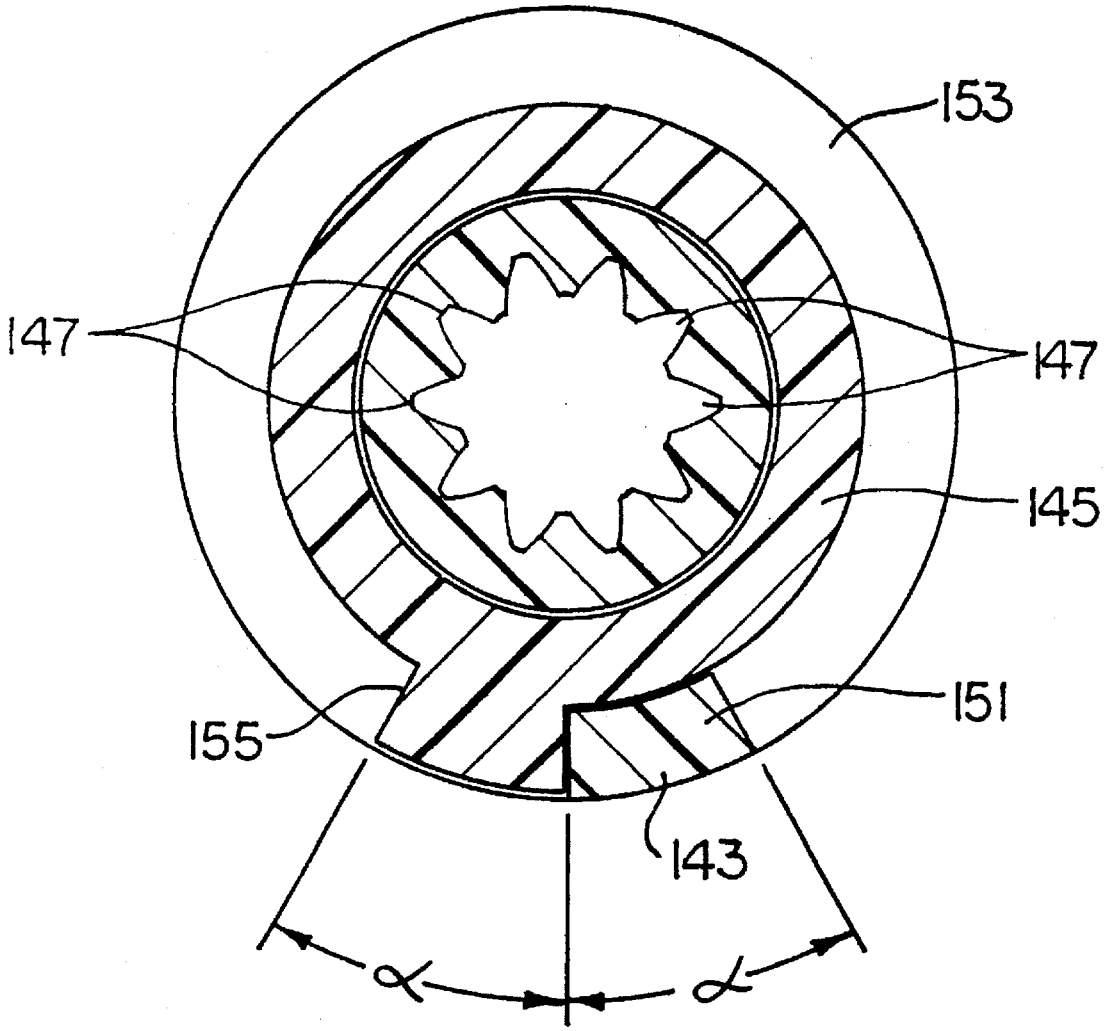
FIG. 25 is a section view of the worm shown in FIG. 23 taken along lines 25-25.
Figure 26:
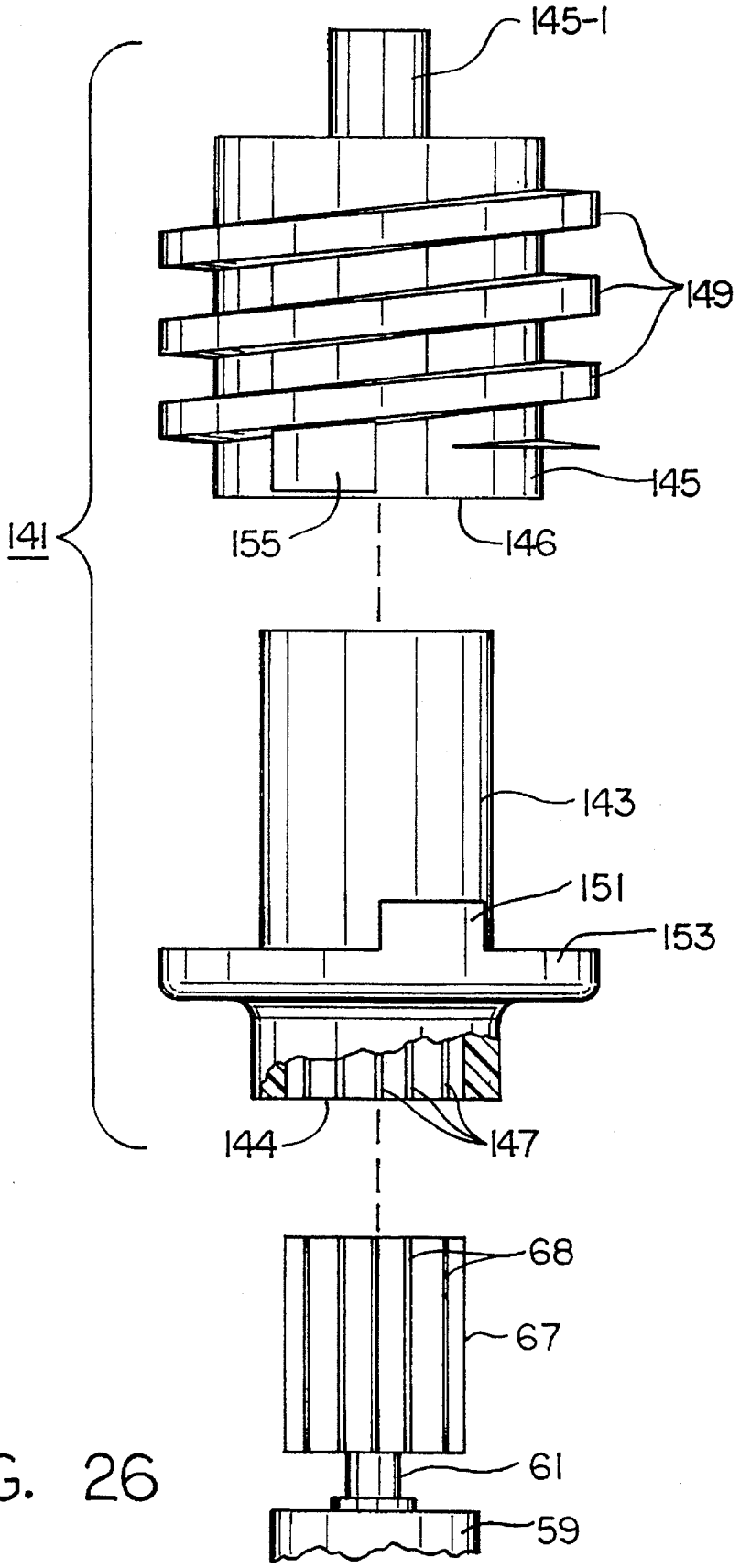
FIG. 26 is an exploded side elevation view partly broken away in part of the worm shown in FIG. 23 and the motor and bushing shown in FIG. 6A.

Referring now to FIGS. 23 through 25, there is shown another embodiment of a worm constructed according to this invention, the worm being identified by reference numeral 141. A partly exploded view showing worm 141 and a portion of electric motor 59 on which worm 141 is mounted is shown in FIG. 26.

Worm 141 includes an elongated cylindrically shaped inner piece 143 open at its front end 144 and slidably mounted on bushing 67 which is fixedly mounted on the end of drive shaft 61 of DC motor 59. Worm 141 also includes an elongated cylindrically shaped outer piece 145 open at its front end 146 and slidably mounted on inner piece 143. Outer piece 145 includes a tip 145-1 at its rear end which is used for the same purpose as tip 72 in worm 65. Rotational movement of inner piece 143 relative to bushing 67 is prevented by a set of splines 147 integrally formed on the inside surface of inner piece 143 which mesh with the set of splines 68 on bushing 67.

The outside surface of outer piece 145 has threads 149 which are sized to mesh with threads on worm gear 73.

Inner piece 143 and outer piece 145 are coupled together in a loose manner for rotational movement by a paddle 151 integrally formed on a flange 153 on the outside surface of inner piece 143 and a paddle 155 integrally formed on the outside surface of outer piece 145. Paddles 151 and 155 are sized to that inner piece 143 will have to rotate almost one revolution in either direction before paddle 151 hits up against paddle 155 on outer piece 145 to rotate with it. For example, paddles 151 and 155 may be sized to each define an angle of 36 degrees so that inner piece 143 has to rotate 288 degrees in each direction before paddle 151 hits up against paddle 155. This loose interconnection allows motor 59 to get up to high speed before worm 141 engages worm gear 73. This prevents stalling of motor 59, in the event of a jam especially when it is being reversed.

The embodiments of the present invention described above are intended to be merely exemplary and those skilled in the art shall be able to make numerous variations and modifications to it without departing from the spirit of the present invention. All such variations and modifications are intended to be within the scope of the present invention as defined by the appended claims.

What is claimed is:

1. Apparatus for dispensing plastic fasteners from fastener stock, each plastic fastener having a cross bar at the end of a filament, said apparatus comprising:

a casing, a hollow needle mounted on said casing, said hollow needle having an inlet opening, a guide groove in said casing for receiving fastener stock, said guide groove being in communication with said inlet opening in said hollow needle, a feeder element for intermittently advancing said fastener stock loaded into said guide groove, an ejector rod for pushing plastic fasteners from said fastener stock through and out of said hollow needle one at a time, said ejector rod being mounted on said slider, a DC motor for driving said ejector rod and said feeder element, said electric motor having a drive shaft, a converter assembly for converting rotary motion of the drive shaft of said DC motor into linear motion, said converter assembly including:

a worm gear, a slider, a rack mounted on the slider, a worm, said worm including an inner piece mounted on the drive shaft of the DC motor and an outer piece slidably mounted on said inner piece in engagement with said worm gear and coupled to said inner piece in a loose manner for rotational movement relative thereto, a spur gear in engagement with the rack and coupled to the worm gear, and control means for controlling the operation of said DC motor so as to produce intermittent reciprocating linear movement of said ejector rod.

2. The apparatus of claim 1, wherein said inner piece is loosely coupled to said outer piece by a pair of paddles, one on said inner piece and the other on said outer piece.

3. The apparatus of claim 2 and further including means on said worm and said drive shaft for preventing rotational movement of said inner piece relative to said drive shape.

4. The apparatus of claim 1 wherein said spur gear is loosely coupled to said worm gear.

5. The apparatus of claim 2 wherein said paddles are sized to allow for almost one revolution of said inner piece before said inner piece engages said outer piece.

6. A converter assembly for converting rotary motion of a drive shaft of a DC motor into linear motion of an ejector rod, said converter assembly including:

a worm gear, a slider, a rack mounted on the slider, a worm, said worm including an inner piece mounted on the drive shaft of the DC motor and an outer piece slidably mounted on said inner piece in engagement with said worm gear and coupled to said inner piece in a loose manner for rotational movement relative thereto, a spur gear in engagement with the rack and coupled to the worm gear, and control means for controlling the operation of said DC motor so as to produce intermittent reciprocating linear movement of said ejector rod.

* * * * *